United States Patent [19]

Beyer

[11] Patent Number: 5,044,250

[45] Date of Patent: Sep. 3, 1991

[54] DRUMSTICK WITH SOUNDING PELLETS

[76] Inventor: David M. Beyer, 3530 Dover St., Los Angeles, Calif. 90039

[21] Appl. No.: 529,500

[22] Filed: May 29, 1990

[51] Int. Cl.[5] ..... G10D 13/02

[52] U.S. Cl. ..... 84/422.4; D17/22; D21/65

[58] Field of Search ..... 84/422.1, 422.4, 402, 84/418; 446/418, 419; D17/22, 99; D21/64, 65

[56] References Cited

U.S. PATENT DOCUMENTS

| | | | |
|---|---|---|---|
| 2,485,824 | 10/1949 | Gladstone | 84/422.4 |
| 2,521,336 | 9/1950 | Bramson | 84/422.4 |
| 3,566,737 | 3/1971 | Gussak | 84/402 |
| 4,165,671 | 8/1979 | DeBose | 84/402 |
| 4,202,241 | 5/1980 | Lucas | 84/422.4 |

*Primary Examiner*—Brian W. Brown
*Attorney, Agent, or Firm*—James E. Brunton

[57] ABSTRACT

A drumstick of the character used in an orchestra or band having an elongated hollow body partially filled with a number of small sound pellets to which various types of tips can be interconnected. The body portion of the drumstick is preferably constructed from a polycarbonate plastic tubing or like material so that movement and vibration of the drumstick will cause the pellets to rattle within the hollow body in a manner to produce a wide variety of rhythmic sounds. An infinite number of sounds can be produced by varying the angle at which the drumstick is held and by varying the number and character of the pellets contained within the hollow housing.

10 Claims, 1 Drawing Sheet

36
34b
38
34
34a
16
14

16
20
2
14
12
22
24
18
2

20
20b
20a
16
14
22
12
18
24

32
32b
16
32a
14

30a
30
30a
16
14

26
26c
26b
27
26d
26a
16
14

DRUMSTICK WITH SOUNDING PELLETS

BACKGROUND OF THE INVENTION

FIELD OF THE INVENTION

The present invention relates generally to drumsticks of the character used in an orchestra or band. More particularly, the invention concerns a drumstick having a hollow casing filled with sound-producing pellets that generate musical or other tones.

DISCUSSION OF THE INVENTION

INTRODUCTION

In a typical band, maracas are often used during the playing of certain pieces. As a general rule the drummer is used to shake the maracas. Accordingly, when the maracas are used, the drums are not played and vice versa.

The thrust of the present invention is to provide a drumstick of unique design having various types of interchangeable tips which, when used to strike the drums or cymbals, will also produce a maraca-like effect in perfect rhythm. This is accomplished by providing a drumstick having an elongated hollow body partially filled with a number of small sounding pellets. The body portion is preferably constructed from a polycarbonate plastic tubing or like material so that movement and vibration of the drumstick will cause the pellets to rattle within the hollow body in a manner to produce a wide variety of rhythmic sounds. An infinite number of sounds can be produced by varying the angle at which the drumstick is held and by varying the number and character of the pellets contained within the hollow housing.

In the past drummers were forced to deal with the inconvenience of changing drumsticks while performing to achieve different sounds and effects. For example, drummers would typically alternate among conical wooden sticks, brushes, rubber mallets, felt mallets and maracas during the performance of a particular score. With the device of the present invention, all of these sounds and effects can be achieved without changing drumsticks.

SUMMARY OF THE INVENTION

It is an object of the present invention to provide a drumstick of novel design which, when used to strike a drum or cymbal, will produce a pleasing, rhythmic, maraca-like sound.

It is another object of the invention to provide a drumstick of the aforementioned character which includes a hollow body partially filled with sounding pellets that will rattle within the drumstick during normal use of the drumstick by the drummer.

Another object of the invention is to provide a drumstick as described in the preceding paragraph to which a variety of differently configured tips can be easily connected to enable the drummer to accomplish cymbal rolls, brush work, snare drum parts and maraca parts without changing drumsticks.

Another object of the invention is to provide a drumstick of the character described to which sounding pellets can be quickly added or removed to produce different sounds.

Another object of the invention is to provide a drumstick of the character described in the preceding paragraphs which is slightly heavier than the standard drumstick so that it can conveniently be used as a warm-up stick.

Still another object of the invention is to provide a drumstick of the class described that is attractive, easy to use and inexpensive t manufacture.

DESCRIPTION OF THE INVENTION

Figures 1, 2, 3, 4, 5, 6:
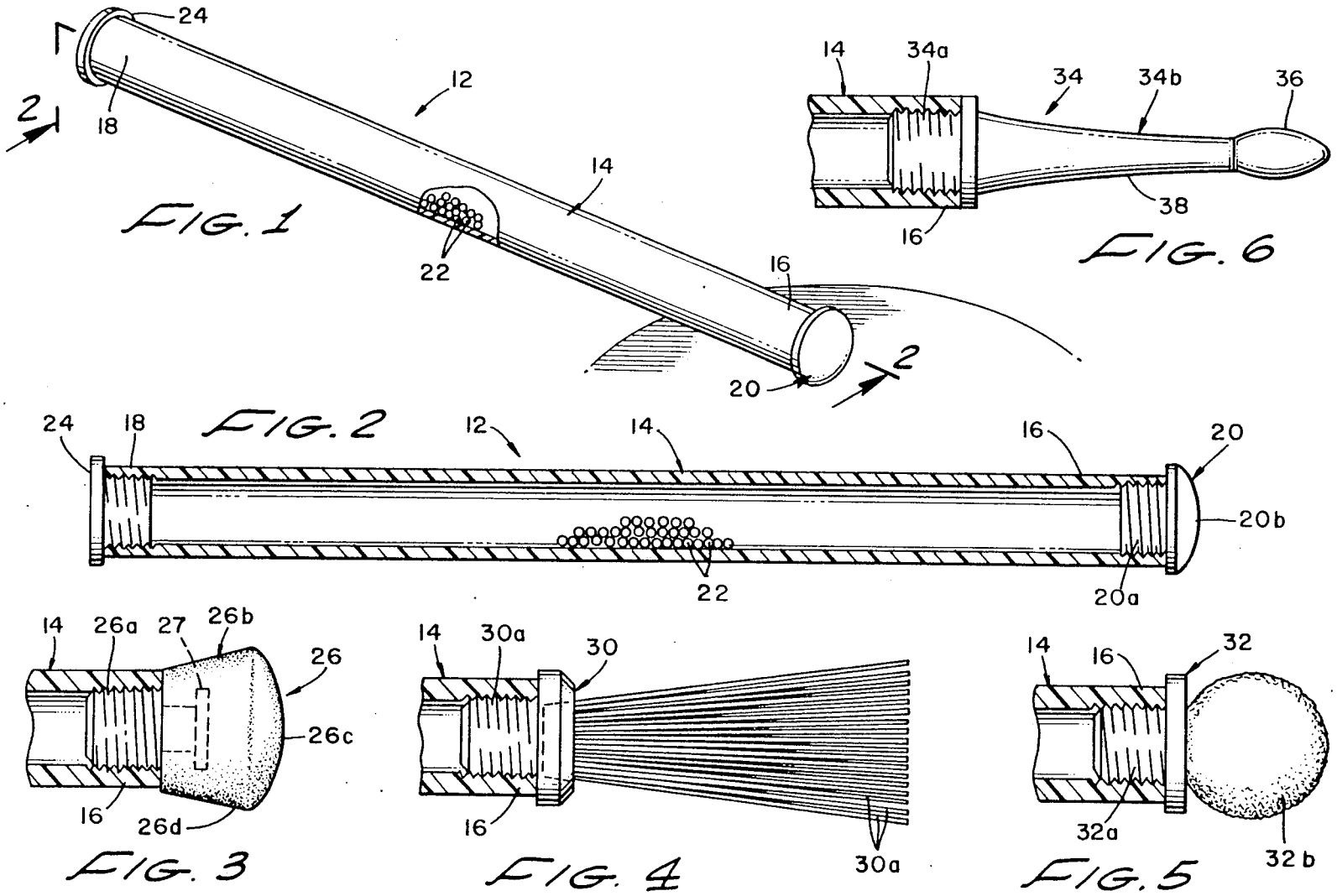
FIG. 1 is a generally perspective view of one form of drum stick of the present invention.
FIG. 2 is an enlarged cross-sectional view taken along lines 2—2 of FIG. 1.
FIG. 3 is an enlarged fragmentary view of the apparatus of the invention showing a differently configured striking tip.
FIG. 4 is an enlarged fragmentary view of a brush-type tip used in connection with the apparatus of the invention.
FIG. 5 is an enlarged fragmentary view of the apparatus of the invention showing still a differently configured striking tip.
FIG. 6 is an enlarged fragmentary view of the apparatus showing yet another type of striking tip.

Referring to the drawings and particularly to FIGS. 1 and 2, the drumstick of the present invention is there shown and generally designated by the numeral 12. In this form of the invention, the drumstick comprises an elongated hollow body 14 having first and second ends 16 and 18, a tip 20 removably connected to first end 16 of hollow body 14 and a multiplicity of pellets 22 disposed within hollow body 14 for movement both axially and radially within the hollow body as the drumstick is used to strike an object such as a drum or cymbal.

As best seen by referring to FIG. 2, both ends of hollow body 14 are internally threaded. First end 16 of the hollow body is adapted to threadably receive a plurality of differently configured tips of the character illustrated in FIGS. 3 through 6. The second end 18 of the hollow body is adapted to threadably receive a closure means here provided as a threaded cap 24. Threaded cap 24 can be easily removed from the second end of the hollow body to permit pellets to be added to or taken away from the interior of the hollow body. While the pellets shown in FIG. 2 are generally spherical and approximately the size of buckshot, it is to be understood that pellets of widely varying size and configuration can be added to the interior of the hollow body 14 to produce different sound effects as the drumstick is being used. The pellets may be constructed of metal, plastic or other suitable material which, upon striking each other or upon striking the inner walls of hollow body 14, will produce musical or other tones.

Body 14 is preferably constructed of a plastic tubing such as polycarbonate. However, other materials can be used to construct the hollow body to produce different sounds as the pellets 22 move about within the hollow body.

The striking tip 20 shown in FIGS. 1 and 2 includes a threaded shank portion **20*a* which is threadably received within the internally threaded first end 16 of hollow body 14 and a generally hemispherical shaped ridged striking portion 20*a* constructed of hard rubber, plastic, or like material. Tip 20** can be used to strike a drum, cymbal or other object much in the same manner as a conventional drumstick. However, as the tip strikes the drum, cymbal or other object, the pellets within the hollow body will move axially and radially of the body creating a wide variety of musical tones. By changing the angle at which the drumstick is held during playing the drum, different sounds can be produced by the pellets striking the interior walls of the hollow body. Similarly, by adding or taking away pellets from the hollow body or by adding pellets of a different configuration and material, widely varying sounds can be obtained as the drumstick is used in its normal manner to strike the drums and cymbals.

Turning to FIG. 3, another configuration of tip usable in connection with hollow body 14 is there illustrated and generally designated by the numeral 26. Tip 26 has a threaded shank portion 26*a* and a striking tip portion 26*b*. Portion 26*b* includes a generally hemispherical shaped first portion 26*c* which is integrally formed with a skirt portion 26*d* which is interconnected by a suitable connector 27 with threaded shank portion 26*a*. Tip 26 may be constructed of natural or synthetic rubber or any other suitable type of resiliently formable material.

Turning to FIG. 4, still another configuration of tip is there illustrated and generally designated by the numeral 30. Tip 30 produces the same type of sound as the conventional brush and comprises a first connector portion 30*a* for threadable interconnection with the first end of hollow body 14 and a multiplicity of elongated flexible fingers 30*b* connected to portion 30*a* and extending outwardly therefrom.

Turning to FIG. 5, still another type of tip usable with the hollow body 14 is there illustrated and generally designated by the numeral 32. Tip 32 comprises a threaded shank portion receivable within end 16 of hollow body 14 and further includes a generally spherical shaped portion 32*b* which is connected to threaded shank 32*a*. Portion 32*b* can be constructed of a soft felt-like material which will produce a sound similar to the sound made by a conventional felt mallet of the character used by the drummer. A wide variety of other materials can be used to construct portion 32*b* to produce the desired sound when the tip is used to strike the drum or cymbal.

Turning finally to FIG. 6, yet another form of tip usable with the hollow body 14 is there illustrated and generally designated by the numeral 34. Tip 34 also has a threaded shank portion 34*a* adapted to threadably engage in 16 of hollow body 14. Formed integrally with portion 34*a* is a striking portion 34*b* which has the generally configuration of a conventional wooden drumstick. More particularly, portion 34*b* comprises a first generally oval shaped end portion 36 which is integrally formed with a second elongated tapered portion 38 which is, in turn, integrally formed with threaded shank portion 34*a*. When tip 34 is used in connection with housing 14, sounds comparable to that produced by a conventional wooden drumstick will be produced. Once again, however, depending upon the number and character of pellets 22 disposed within housing 14 and the angle at which the drumstick is held, a wide variety of maraca-like sounds can be produced.

Having now described the invention in detail in accordance with the requirements of the patent statutes, those skilled in this art will have no difficulty in making changes and modifications in the individual parts or their relative assembly in order to meet specific requirements or conditions. Such changes and modifications may be made without departing from the scope and spirit of the invention, as set forth in the following claims.

I claim:

1. A drumstick for use in striking a drum or cymbal comprising:

(a) an elongated hollow body having first and second ends and a gripping portion located proximate said second end for gripping said hollow body while striking the drum or cymbal;

(b) a tip for striking the drum or cymbal removably connected to said first end of said hollow body; and (c) a multiplicity of pellets disposed within said hollow body for movement both axially and radially within said hollow body as said body is moved during the striking of the drum or cymbal, whereby said pellets will rattle within said hollow body to produce rhythmic sounds.

2. A drumstick as defined in claim 1 further including closure means removably connected to said second end of said hollow body to enable pellets to be added or removed therefrom.

3. A drumstick as defined in claim 1 in which said tip is generally hemispherical in shape.

4. A drumstick as defined in claim 1 in which said tip is generally spherical in shape.

5. A drumstick as defined in claim 1 in which said tip comprises a generally hemispherical first portion and a skirt portion connected to said first portion, said skirt portion terminating in a connector means for interconnection with said first end of said hollow body.

6. A drumstick as defined in claim 1 in which said tip comprises a first generally oval shaped portion and a second elongated tapered portion integrally formed with said first portion, said second portion terminating in a connector means for interconnection with said first end of said hollow body.

7. A drumstick as defined in claim 1 in which said tip comprises a first connector portion for interconnecting with said first end of said hollow body and a multiplicity of elongated, flexible fingers connected to said first connector portion and extending outwardly therefrom.

8. A drumstick for use in striking a drum or cymbal comprising:

(a) an elongated hollow body constructed from polycarbonate tubing and having first and second ends and an intermediate portion for gripping said hollow body while striking the drum or cymbal;

(b) a plurality of tips for striking the drum or cymbal adapted to be removably connected to said first end of said hollow body;

(c) a multiplicity of sounding pellets disposed within said intermediate portion of said hollow body for independent movement both axially and radially within said hollow body as said body is moved during the striking of the drum or cymbal whereby said pellets will rattle within said hollow body to produce sounds which are variable depending upon the angle at which the drumstick is held; and (d) closure means removably connected to said second end of said hollow body to enable pellets to be added or removed therefrom whereby the sound produced during movement of said body can be varied.

9. A drumstick as defined in claim 8 in which each of said tips has first and second ends, said second end being adapted to strike a drum or cymbal and said first end being threaded.

10. A drumstick as defined in claim 9 in which said first end of said hollow body is provided with threads for threadable engagement with said first end of said tips.

* * * * *